US012559215B2

(12) United States Patent
Hao et al.

(10) Patent No.: US 12,559,215 B2
(45) Date of Patent: Feb. 24, 2026

(54) WIND-POWERED WATER-AIR INTERFACE VEHICLE SUITABLE FOR CONCEALED NAVIGATION

(71) Applicant: INSTITUTE OF OCEANOGRAPHIC INSTRUMENTATION, SHANDONG ACADEMY OF SCIENCES, Shandong (CN)

(72) Inventors: Zongrui Hao, Shandong (CN); Kailin Li, Shandong (CN); Wanlong Ren, Shandong (CN); Yue Wang, Shandong (CN); Zhili Hua, Shandong (CN); Gang Liu, Shandong (CN); Juan Xu, Shandong (CN)

(73) Assignee: INSTITUTE OF OCEANOGRAPHIC INSTRUMENTATION, SHANDONG ACADEMY OF SCIENCES, Qingdao (CN)

( * ) Notice: Subject to any disclaimer, the term of this patent is extended or adjusted under 35 U.S.C. 154(b) by 0 days.

(21) Appl. No.: 19/007,421

(22) Filed: Dec. 31, 2024

(65) Prior Publication Data

US 2025/0214691 A1 Jul. 3, 2025

(30) Foreign Application Priority Data

Apr. 1, 2024 (CN) ..... 202410381271.X

(51) Int. Cl.
*B63H 9/067* (2020.01)
*B63H 9/10* (2006.01)

(52) U.S. Cl.
CPC ..... *B63H 9/067* (2020.02); *B63H 9/1021* (2013.01); *B63H 2009/105* (2013.01)

(58) Field of Classification Search
CPC ..... B63H 9/00; B63H 9/067; B63H 9/1021; B63H 2009/105
USPC ..... 114/102.29
See application file for complete search history.

(56) References Cited

U.S. PATENT DOCUMENTS

| | | | | |
|---|---|---|---|---|
| 5,263,429 | A * | 11/1993 | Brinkmann | B63H 9/061 114/90 |
| 6,112,688 | A * | 9/2000 | Jurriens | B63H 8/21 114/97 |
| RE38,448 | E * | 3/2004 | Jurriens | B63H 8/40 114/97 |
| 2007/0157864 | A1 | 7/2007 | Aldin et al. | |
| 2016/0236762 | A1 | 8/2016 | Johnston et al. | |
| 2018/0162502 | A1 | 6/2018 | McClure et al. | |

* cited by examiner

*Primary Examiner* — Daniel V Venne

(57) ABSTRACT

A water-air interface vehicle suitable for concealed navigation. A gybing box is arranged in a hull and includes a gybing motor, a gear train, a worm wheel and worm mechanism and a base; the worm wheel and worm mechanism are connected with a shaft of the gybing motor by the gear train; the base is connected with the worm wheel and worm mechanism; the transformable sail is fixed to the base; the gybing box is connected with a reefing mechanism; the gybing box operates the transformable sail in a set attack angle range or rotates 90 degrees according to a signal sent by a control system.

5 Claims, 8 Drawing Sheets

WIND-POWERED WATER-AIR INTERFACE VEHICLE SUITABLE FOR CONCEALED NAVIGATION

TECHNICAL FIELD

The present invention belongs to the technical field of vehicles, and pertains to a wind-powered water-air interface vehicle suitable for concealed navigation.

BACKGROUND

At present, the combined power platform technology has made certain developments, which are mainly used in marine monitoring, environmental science research, marine resources exploration and other fields. Existing surface platforms are usually powered by wind or solar energy, have the characteristics of autonomous navigation and long-term cruising, are widely used for data collection and monitoring tasks, and have the capability of perform various exploration tasks at sea.

The existing surface platforms have some limitations and disadvantages. First, their performance in harsh environmental conditions is limited due to reliance on wind or solar energy, affecting its reliability and sustainability in certain environments. Due to the single navigation form, the limited ability of the prior art to respond to emergencies and urgent tasks, therefore, a more powerful emergency response mechanism is needed to ensure that tasks can be performed quickly and efficiently at critical times. In addition, the existing surface platforms have limited ability to respond to emergencies, urgent tasks and harsh meteorologic conditions, and present certain risks.

Therefore, there is an urgent need for a new surface platform technology with multiple navigation modes, sail transformation, and bionic undulating propulsion to overcome the above disadvantages and improve its adaptability and emergency response capability under different environmental conditions.

SUMMARY

In order to solve the problems of the prior art, the present invention provides a wind-powered water-air interface vehicle suitable for concealed navigation, which includes a hull, a gybing box, a transformable sail and a reefing mechanism, where the gybing box is arranged in the hull and includes a gybing motor, a gear train, a worm wheel and worm mechanism and a base; the worm wheel and worm mechanism are connected with a shaft of the gybing motor by the gear train; the base is connected with the worm wheel and worm mechanism; the transformable sail is fixed to the base; the gybing box is connected with the reefing mechanism; the gybing box operates the transformable sail in a set attack angle range or rotates 90 degrees according to a signal sent by a control system.

Preferably, the reefing mechanism includes a front ballast water tank, a rack piston, a primary drive shaft, a drive shaft gear, a reefing drive shaft, a reefing gear disk and a slider crank mechanism; a piston end of the rack piston and the front ballast water tank form a piston structure; a rack end of the rack piston is intermeshed with the drive shaft gear; the drive shaft gear is connected with the primary drive shaft; the primary drive shaft and the reefing drive shaft are connected by a belt gear; the reefing drive shaft is connected with the reefing gear disk; one end of the slider crank mechanism is connected with the reefing gear disk, and the other end of the slider crank mechanism is connected with a housing of the gybing box by a connecting shaft; the front ballast tank is charged with seawater under control of the control system to cause the rack piston to act, and drive the primary drive shaft, the reefing drive shaft and the reefing gear disk to rotate, thereby driving the slider crank mechanism to rotate the gybing box.

Preferably, the slider crank mechanism includes a reefing limiting box, a reefing bracket, a reefing chute, a reefing slider, a rail base and a connecting shaft; and the reefing slider is mounted to a sliding rail of the rail base, one end of the reefing slider is mounted in the reefing chute, the reefing sliding groove is mounted to the reefing bracket by a connecting shaft, and the reefing limiting box is mounted to the reefing bracket by screws.

Preferably, the gear disk includes a rotating ring, a gear disk base, an internal gear, a drive handle, an electromagnetic switch and an external gear; the rotating ring is mounted to the gear disk base by a bearing, the internal gear is mounted to a gear column on the rotating ring, the drive handle is a rotatable joint, one end thereof is mounted to an upper end of the gear column on the rotating ring, and the other end thereof is connected with a gear disk connecting rod; the external gear is fixed to the gear disk base by screws, the internal gear is meshed with the external gear, and the gear disk base is fixed to the rail base by screws; the gear disk connecting rod is connected with the reefing slider; and the drive handle is provided thereon with the electromagnetic switch for controlling connection and disconnection of the drive handle and the internal gear.

Preferably, the reefing limiting box is provided thereon with a vertical limiter and a horizontal limiter for limiting and fixing the transformable sail at a vertical position and a horizontal position respectively.

Preferably, the transformable sail includes a secondary drive shaft, a wingsail fixing portion, a wingsail right transformation portion and a wingsail left transformation portion; the wingsail right transformation portion and the wingsail left transformation portion are hingedly connected with the wingsail fixing portion; the wingsail fixing portion is fixed to a transformable sail base, an upper end of the secondary drive shaft passes through the wingsail fixing portion and is fixed to a limiting plate, and a lower end of the secondary drive shaft is configured to connect with the primary drive shaft; a Z-shaped connecting rod mechanism is mounted on an upper portion of the secondary drive shaft; both ends of the Z-shaped connecting rod mechanism are respectively connected with the wingsail right transformation portion and the wingsail left transformation portion by buttonheads; and when the secondary drive shaft is connected with the primary drive shaft, the secondary drive shaft rotates with the primary drive shaft to drive the Z-shaped connecting rod mechanism to rotate, so that the wingsail right transformation portion and the wingsail left transformation portion are deployed or furled.

Preferably, the wind-powered water-air interface vehicle further includes an undulating propulsion mechanism, the undulating propulsion mechanism includes a flexible fin, a plurality of fin rays and an undulating propulsion steering gear, and the flexible fin is fixed to the fin rays; and each fin ray is connected to an undulating propulsion steering gear, and the undulating propulsion steering gear is fixed to the wingsail fixing portion.

The wind-powered water-air interface vehicle according to the present invention can be freely switched in both a surface navigation mode and an underwater navigation mode by using the reefing mechanism and the transformable sail, and can be more flexibly adapted to different mission requirements, including various application scenarios such as marine investigation and resource exploration.

DESCRIPTION OF THE EMBODIMENTS

Figure 1:
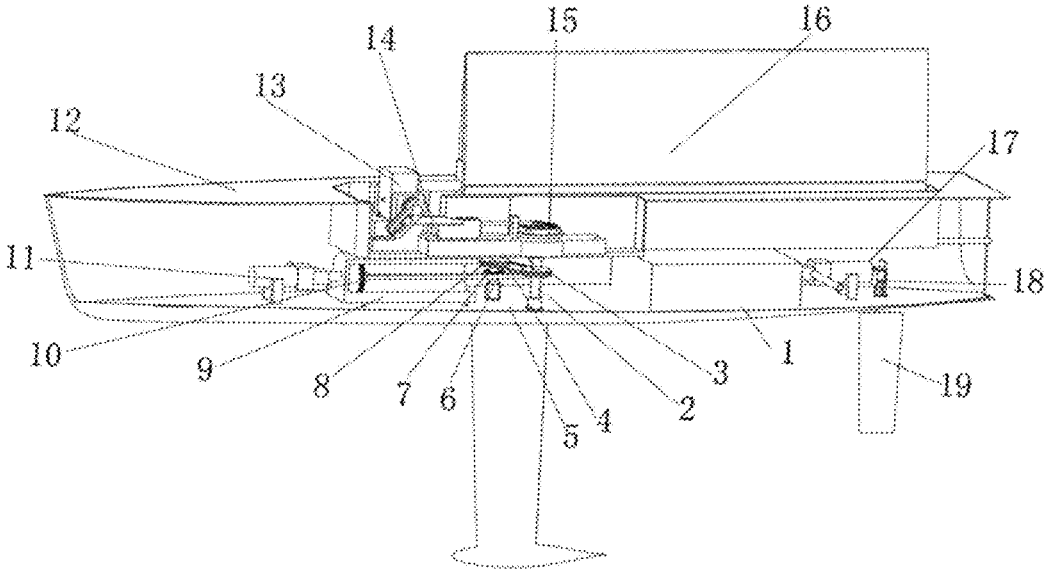
FIG. 1 is an overall structural schematic diagram of a wind-powered water-air interface vehicle suitable for concealed navigation according to an embodiment of the present invention.

Embodiments of the present invention will now be described in detail below, and examples of specific embodiments are illustrated in the accompanying drawings, where the same or similar reference numerals throughout represent the same or similar elements or elements having the same or similar functions. The embodiments described below with reference to the accompanying drawings are exemplary, are intended to explain the present invention, and should not be construed as a limitation to the present invention.

According to the present invention, there is provided an overall structural schematic diagram of a wind-powered water-air interface vehicle suitable for concealed navigation. As shown in FIG. 1, the vehicle mainly includes: a rear ballast water tank 1, a reefing drive shaft 2, a first belt pulley 3, a belt 4, a hull 5, a primary drive shaft 6, a drive shaft gear 7, a second belt pulley 8, a front ballast water tank 9, a rack piston 10, a front ballast water regulating pump 11, a deck 12, a gybing box 13, a slider crank mechanism 14, a gear disk 15, a transformable sail 16, a rear ballast water regulating pump 17, a steering gear 18, and a rudder 19.

Among them, the front ballast water regulating pump 11, the front ballast water tank 9, the rack piston 10, the primary drive shaft 6, the drive shaft gear 7, the first belt pulley 3, the belt 4, the second belt pulley 8, the reefing drive shaft 2, the gear disk 15 and the slider crank mechanism 14 together constitute a reefing mechanism. Meanwhile, the front ballast water regulating pump 11, the front ballast water tank 9, the rack piston 10, the primary drive shaft 6, the drive shaft gear 7 together with the transformable sail 16 constitute a transformable sail mechanism.

As shown in FIG. 1, the front ballast water regulating pump 11 is fixed to the hull 5 by screws, and an inlet end thereof is communicated with the hull, where it is watertight to prevent water from entering the cabin. An outlet end of the front ballast water regulating pump 11 is connected with the front ballast water tank 9, and the front ballast water tank 9 is fixed to the hull 5 by screws. One end of the rack piston 10 is a piston, and the other end is mounted with a gear; the piston end of the rack piston 10 forms a piston structure with the front ballast water tank 9; and the gear end of the rack piston 10 is intermeshed with the drive shaft gear 7.

Figure 2:
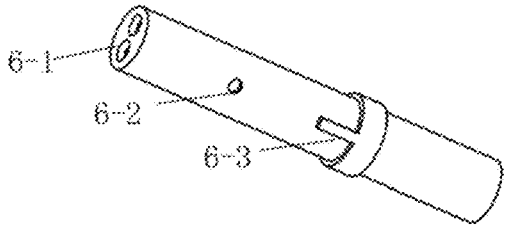
FIG. 2 is a structural schematic diagram of a primary drive shaft according to an embodiment of the present invention.

As shown in FIG. 2, an upper end of the primary drive shaft 6 extends out of the deck 12 and is rotationally sealed, and a lower end thereof is mounted to a bottom of the hull by a bearing. The primary drive shaft 6 is provided with a gear mounting hole 6-3 and a belt pulley mounting hole 6-2 thereon. The drive shaft gear 7 is mounted at the gear mounting hole 6-3, and the second belt pulley 8 is mounted at the belt pulley mounting hole 6-2. An upper end face of the primary drive shaft 6 is machined with two grooves 6-1 for connecting with the secondary drive shaft.

The first belt pulley 3 is mounted to the reefing drive shaft 2; and a bottom end of the reefing drive shaft 2 is mounted to the bottom of the hull 5 by a bearing. The belt 4 is mounted to the second belt pulley 8 and the first belt pulley 3.

Figure 3:
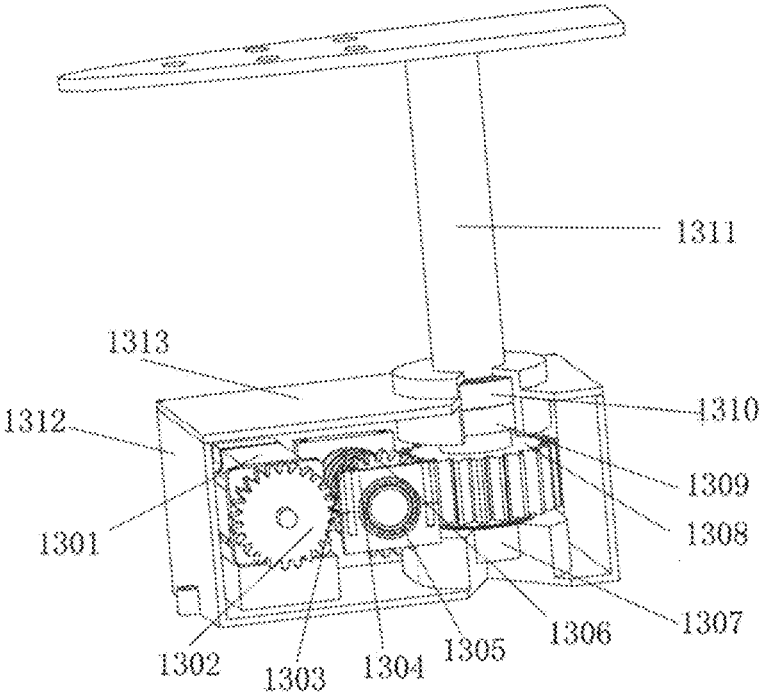
FIG. 3 is a structural schematic diagram of a gybing box according to an embodiment of the present invention.
Figure 4:
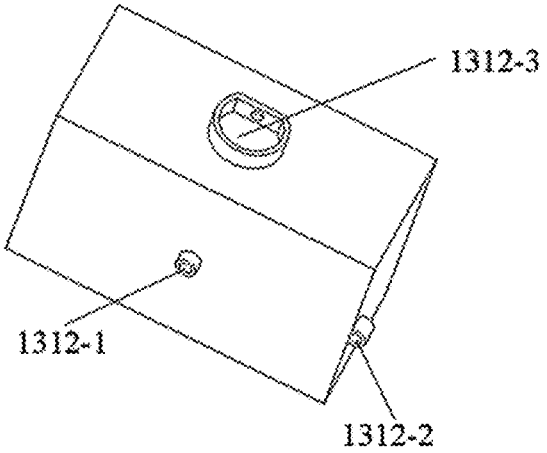
FIG. 4 is a structural schematic diagram of a housing of a gybing box according to an embodiment of the present invention.

As shown in FIGS. 3 and 4, the gybing box 13 includes a gybing motor 1301, a first gear 1302, a worm 1303, a worm fixing block 1304, a first bearing 1305, a second gear 1306, a second bearing 1307, a worm wheel 1308, a third bearing 1309, an oil seal 1310, a base 1311, a gybing box housing 1312 and a gybing box cover 1313. The gybing motor 1301 is mounted to the gybing box housing 1312 by screws, the first gear 1302 is mounted to the gybing motor 1301, the second gear 1306 is mounted to the worm 1303, the worm 1303 is fixed to the gybing box housing 1312 by the worm fixing block 1304 in conjunction with the first bearing 1305, and the first gear 1302 is meshed with the second gear 1306. A shaft end of the base 1311 is mounted to the gybing box housing 1312 in conjunction with the second bearing 1307, a platform end of the base 1311 is sealed by passing the gybing box cover 1313 through the third bearing 1309 and the oil seal 1310, and the worm wheel 1308 is mounted to a shaft of the base 1311 and meshed with the worm 1303. The gybing box housing 1312 is provided with a housing mounting hole 1312-3, a horizontal pneumatic locker self-locking hole 1312-1 and a vertical pneumatic locker self-locking hole 1312-2.

Figure 5:
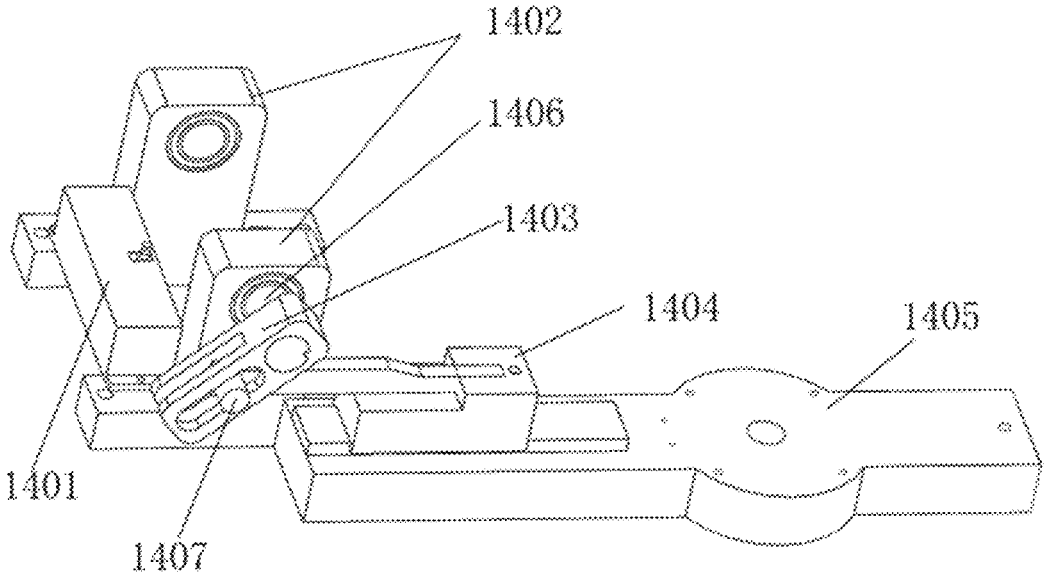
FIG. 5 is a structural schematic diagram of a slider crank mechanism according to an embodiment of the present invention.
Figure 6:
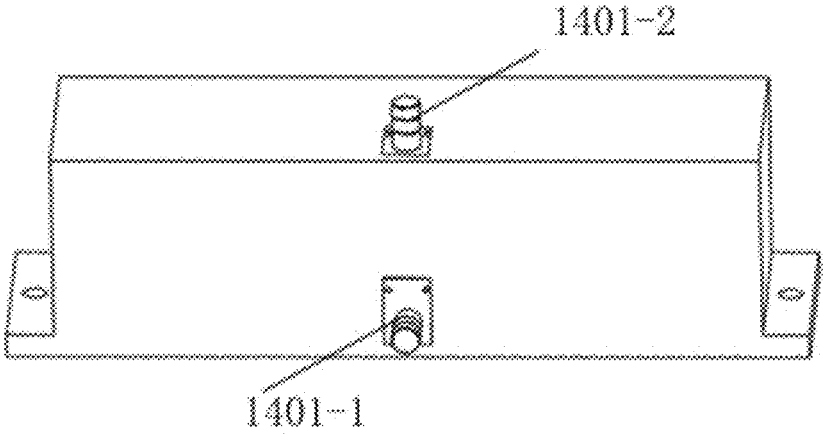
FIG. 6 is a structural schematic diagram of a reefing limiting box according to an embodiment of the present invention.

As shown in FIG. 5, the slider crank mechanism 14 includes a reefing limiting box 1401, a reefing bracket 1402, a reefing chute 1403, a reefing slider 1404, a rail base 1405, a connecting shaft 1406, and a limiting pin 1407. The reefing slider 1404 is mounted to a sliding rail of the rail base 1405, one end of the reefing slider 1404 is mounted to the reefing chute 1403 by the limiting pin 1407, the reefing chute 1403 is mounted to the reefing bracket 1402 by the connecting shaft 1406, and the reefing limiting box 1401 is mounted to the reefing bracket 1402 by screws. As shown in FIG. 6, a vertical pneumatic locker 1401-2 and a horizontal pneumatic locker 1401-1 are mounted on the reefing limiting box 1401. The connecting shaft 1406 is mounted into the housing mounting hole 1312-3 of the gybing box housing 1312, where the gybing box housing 1312 is at an included angle of 45 degrees to the reefing chute 1403.

Figure 7:
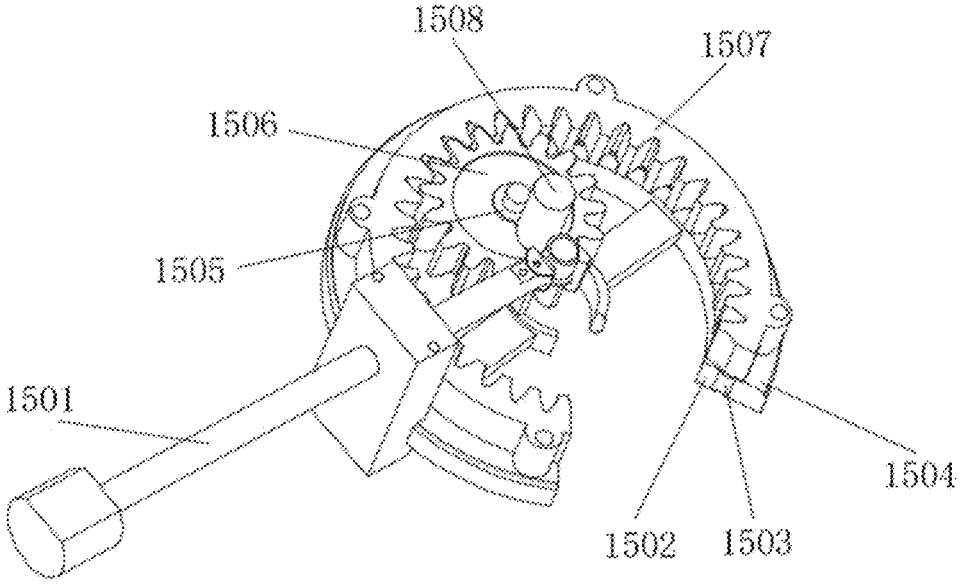
FIG. 7 is a structural schematic diagram of a gear disk according to an embodiment of the present invention.
Figure 8:
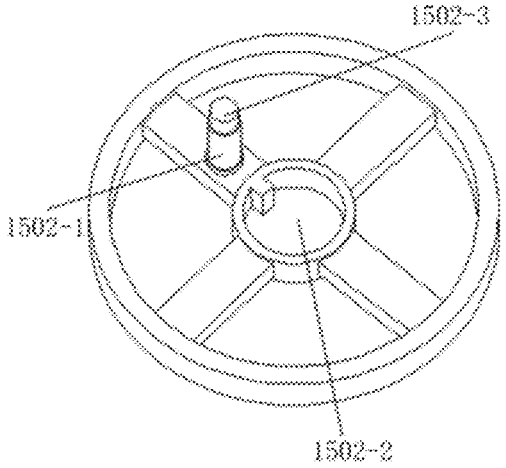
FIG. 8 is a structural schematic diagram of a rotating ring according to an embodiment of the present invention.
Figure 9:
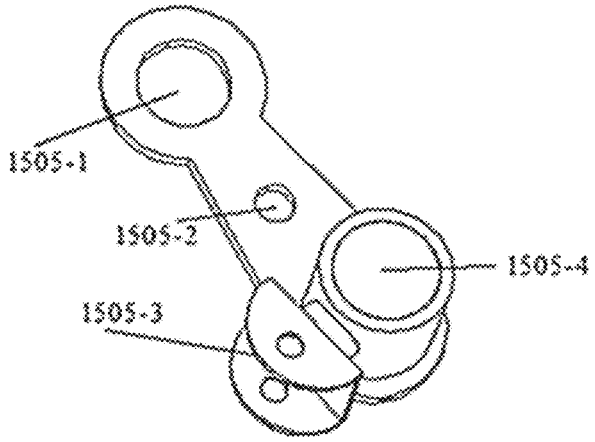
FIG. 9 is a structural schematic diagram of a drive handle according to an embodiment of the present invention.

As shown in FIGS. 7, 8, and 9, the gear disk 15 includes a gear disk connecting rod 1501, a rotating ring 1502, a bearing 1503, a gear disk base 1504, a drive handle 1505, an internal gear 1506, an external gear 1507 and an electromagnetic switch 1508. The rotating ring 1502 is mounted to the gear disk base 1504 by the bearing 1503, the internal gear 1506 is mounted to a gear column 1502-1 of the rotating ring 1502, a handle mounting hole 1505-1 of the drive handle 1505 is mounted to an upper end 1502-3 of the gear column 1502-1 of the rotating ring 1502, the electromagnetic switch 1508 is mounted to an electromagnetic switch mounting hole 1505-2 of the drive handle 1505, and the electromagnetic switch 1508 is controlled by a control system. A connecting rod fixing end 1505-3 of the drive handle 1505 is connected with the gear disk connecting rod 1501. The drive handle 1505 has a rotatable joint 1505-4. The external gear 1507 is fixed to the gear disk base 1504 by screws, the internal gear 1506 is meshed with the external gear 1507, the gear disk base 1504 is fixed to the rail base 1405 by screws, and the gear disk connecting rod 1501 is fixed to the reefing slider 1404 by screws. A grooved end of the reefing drive shaft 2 is mounted to a central hole 1502-2 of the rotating ring 1502.

As shown in FIGS. 10-17, the transformable sail 16 includes a limiting spring 1601, a limiting plate 1602, a secondary drive shaft 1603, a straight connecting rod 1604, a sail transformation connecting rod 1605, a limiting screw 1606, a wingsail fixing portion 1607, a wingsail right transformation portion 1608, and a wingsail left transformation portion 1612. The wingsail fixing portion 1607 is fixed to the platform end of the base 1311 by screws, and the wingsail right transformation portion 1608 and the wingsail left transformation portion 1612 are hingedly connected with the wingsail fixing portion 1607. A drive shaft fixing end 1603-3 of the secondary drive shaft 1603 is mounted into a drive shaft fixing hole 1602-3 of the limiting plate 1602 through a through-shaft hole 1607-1 of the wingsail fixing portion 1607 in conjunction with a bearing. A telescopic shaft 1602-2 of the limiting plate 1602 is mounted into a limiting hole 1607-2 of the wingsail fixing portion 1607, and the telescopic shaft 1602-2 and the limiting hole 1607-2 should have good sliding performance. Both ends of the limiting spring 1601 are respectively welded onto a limiting column bottom end 1607-3 of the wingsail fixing portion 1607 and the limiting plate 1602, four limiting screws 1606 are screwed into the limiting hole 1607-2 of the wingsail fixing portion 1607 through limiting screw holes 1602-1 of the limiting plate 1602, and a fixing hole 1604-2 of the straight connecting rod 1604 is mounted to a straight connecting rod fixing column 1603-2 of the secondary drive shaft 1603, two sail transformation connecting rods 1605 are respectively mounted to a left straight connecting rod fixing column 1604-1 and a right straight connecting rod fixing column 1604-3 of the straight connecting rod 1604, the straight connecting rod 1604 and two sail transformation connecting rods 1605 form a Z-shaped connecting rod mechanism, and the straight connecting rod is rotatable around two fixing columns. Ball ends of the two sail transformation connecting rods 1605 are connected to a right sail deployment slipway 1608-2 of the wingsail right transformation portion 1608 and a left sail deployment slipway 1612-2 of the wingsail left transformation portion 1612 respectively. A lower end of the secondary drive shaft 1603 is machined with two convex columns 1603-1 for connecting with the two grooves 6-1 at the upper end of the primary drive shaft 6.

Figure 10:
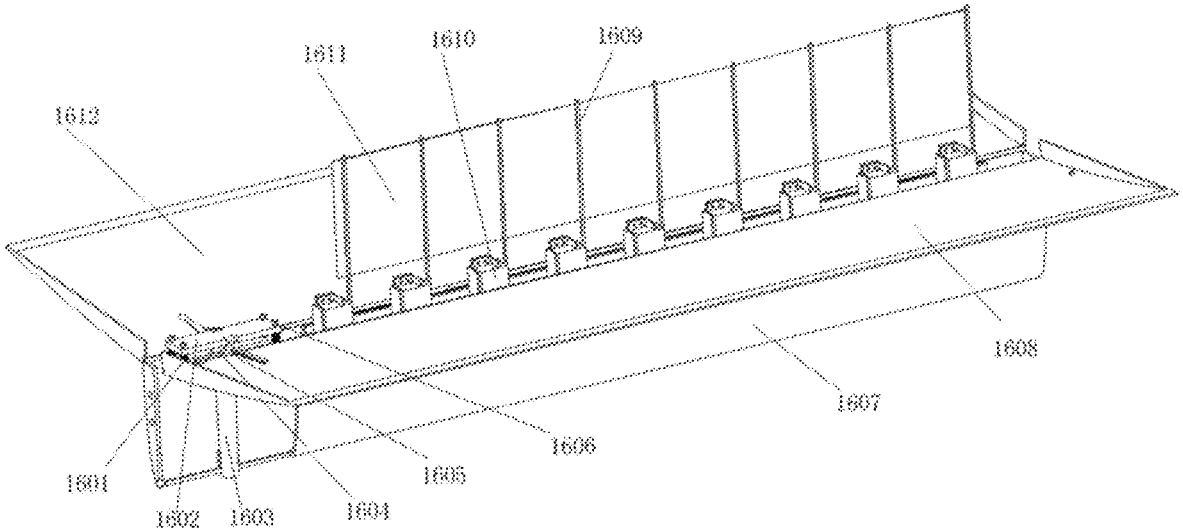
FIG. 10 is a structural schematic diagram of a transformable sail according to an embodiment of the invention.
Figure 11:
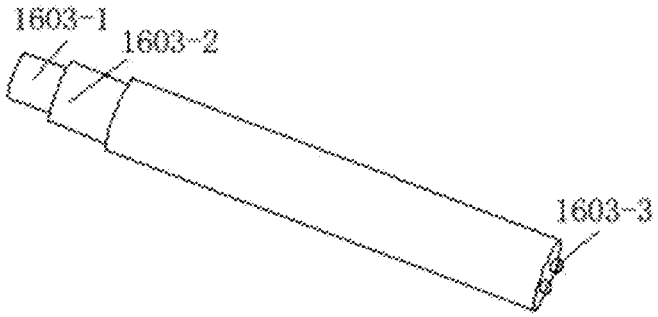
FIG. 11 is a structural schematic diagram of a secondary drive shaft according to an embodiment of the present invention.
Figure 12:
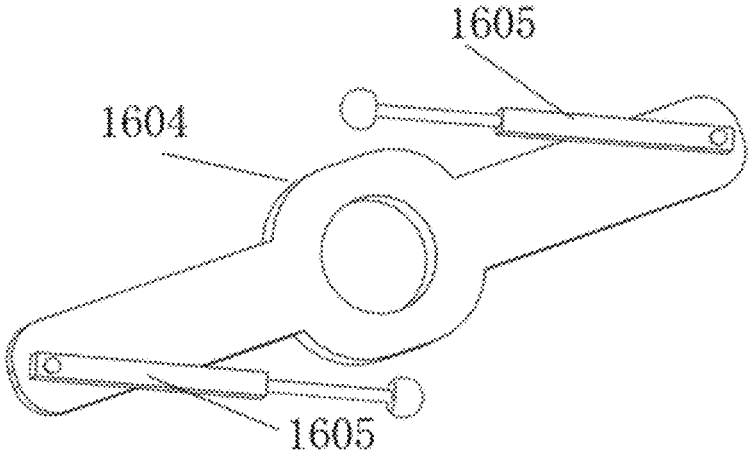
FIG. 12 is a structural schematic diagram of a Z-shaped connecting rod mechanism according to an embodiment of the present invention.
Figure 13:
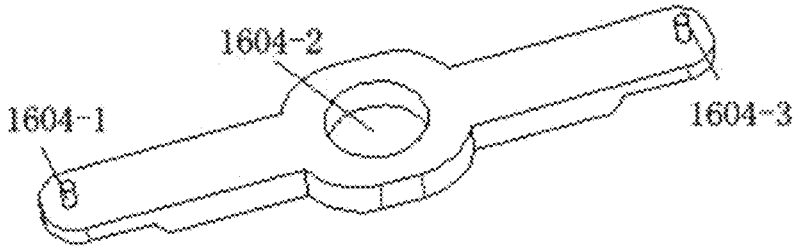
FIG. 13 is a structural schematic diagram of a straight connecting rod according to an embodiment of the present invention.
Figure 14:
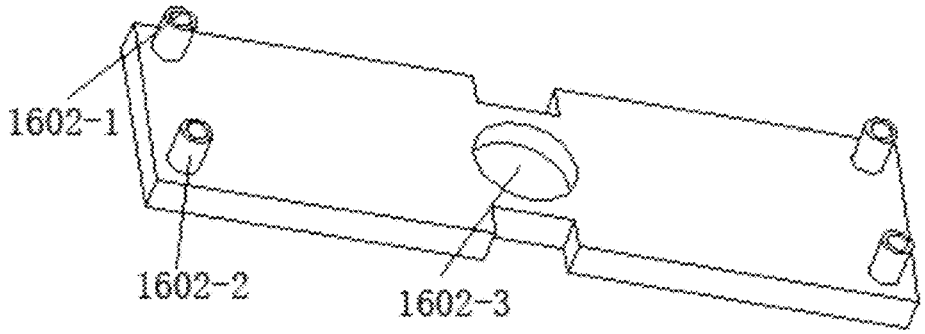
FIG. 14 is a structural schematic diagram of a limiting plate according to an embodiment of the present invention.
Figure 15:
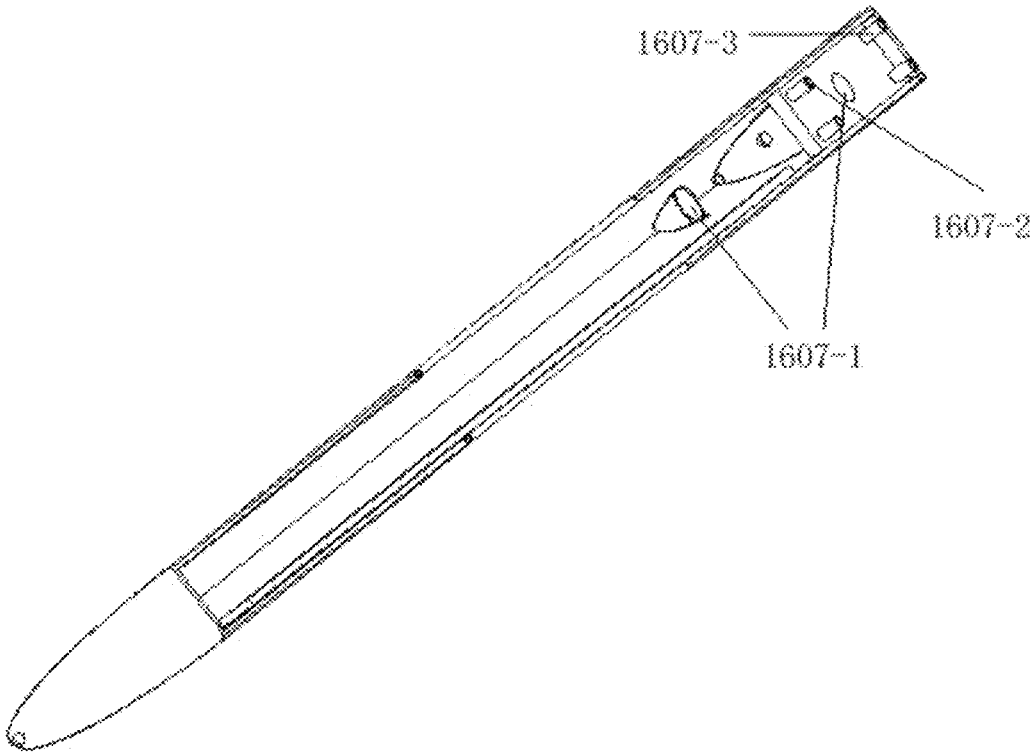
FIG. 15 is a structural schematic diagram of a wingsail fixing portion according to an embodiment of the present invention.
Figure 16:
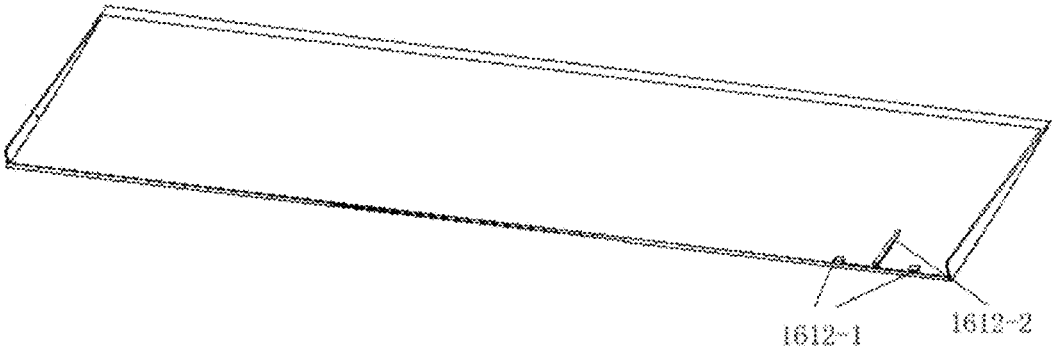
FIG. 16 is a structural schematic diagram of a wingsail left transformation portion according to an embodiment of the present invention.
Figure 17:
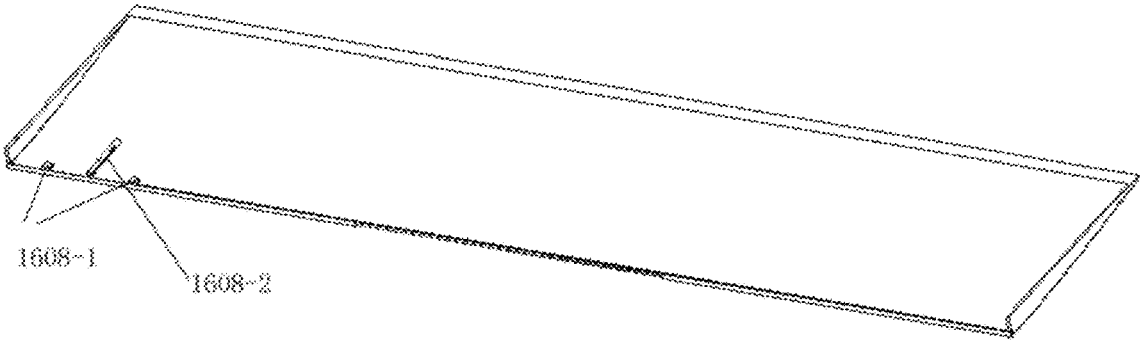
FIG. 17 is a structural schematic diagram of a wingsail right modified portion according to an embodiment of the present invention.

As shown in FIG. 10, an undulating propulsion mechanism is composed of a flexible fin 1611, fin rays 1609 and an undulating propulsion steering gear 1610; the flexible fin 1611 is nailed to the fin rays 1609, the fin rays 1609 are mounted to the undulating propulsion steering gear 1610, and the undulating propulsion steering gear 1610 is fixed to the wingsail fixing portion 1607 by screws.

As shown in FIG. 1, the steering gear 18 is fixed to a rudder axle of the rudder 19, the rear ballast water regulating pump 17 is fixed to the hull 5 by screws, and an inlet end thereof is communicated with the hull, where it is watertight to prevent water from entering the cabin. An outlet end thereof is connected with the rear ballast water tank 1, and the rear ballast water tank 1 is fixed to the hull 5 by screws.

The wind-powered water-air interface vehicle suitable for concealed navigation according to the present invention works according to the working process and principle as described below:

During normal navigation on the sea, only the gybing box 13 is working, and the transformable sail is in an upright condition. According to a signal sent by an offshore wind direction control system, the transformable sail 16 works in a set attack angle range, the gybing motor 1301 work to drive the first gear 1302 and the second gear 1306 to rotate, then drive the worm 1303 and the worm wheel 1308 to rotate, and finally drives the base 1311 to rotate, thereby realizing rotation of the transformable sail 16 as the transformable sail 16 is fixed to the base 1311. The gybing motor 1301 stops working after the rotation reaches a specified angle, and self-locking after gybing is achieved due to a self-locking function of the motor itself, and a mechanical self-locking principle that the worm wheel 1308 cannot drives the worm 1303 to rotate in a reverse direction, where a drive ratio of the first gear 1302, the second gear 1306, the worm 1303 and the worm wheel 1308 is 1:1:1:1.

Figure 18:
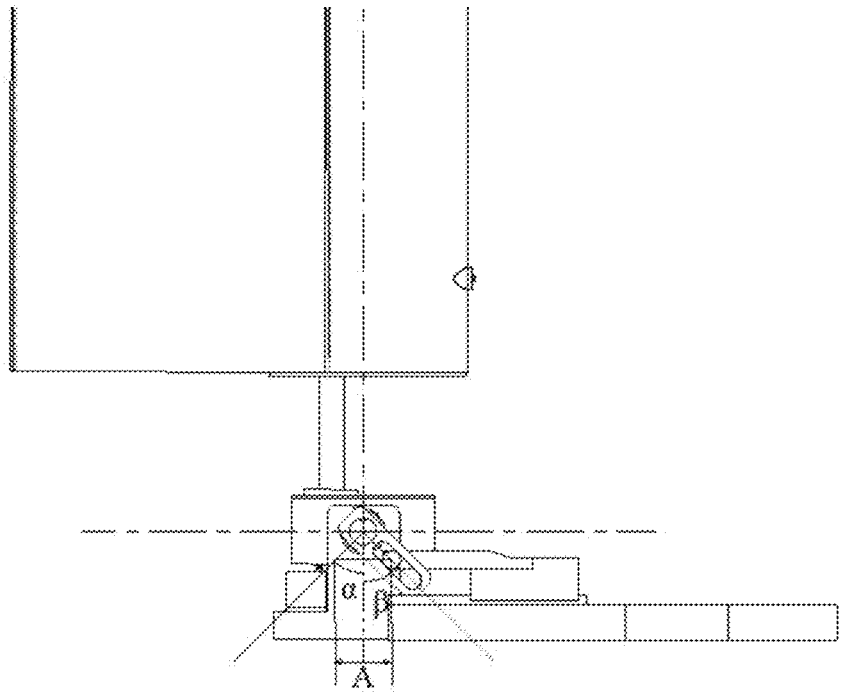
FIG. 18 is a schematic diagram of a position of a reefing chute when a sail is in an upright position according to an embodiment of the present invention.
Figure 19:
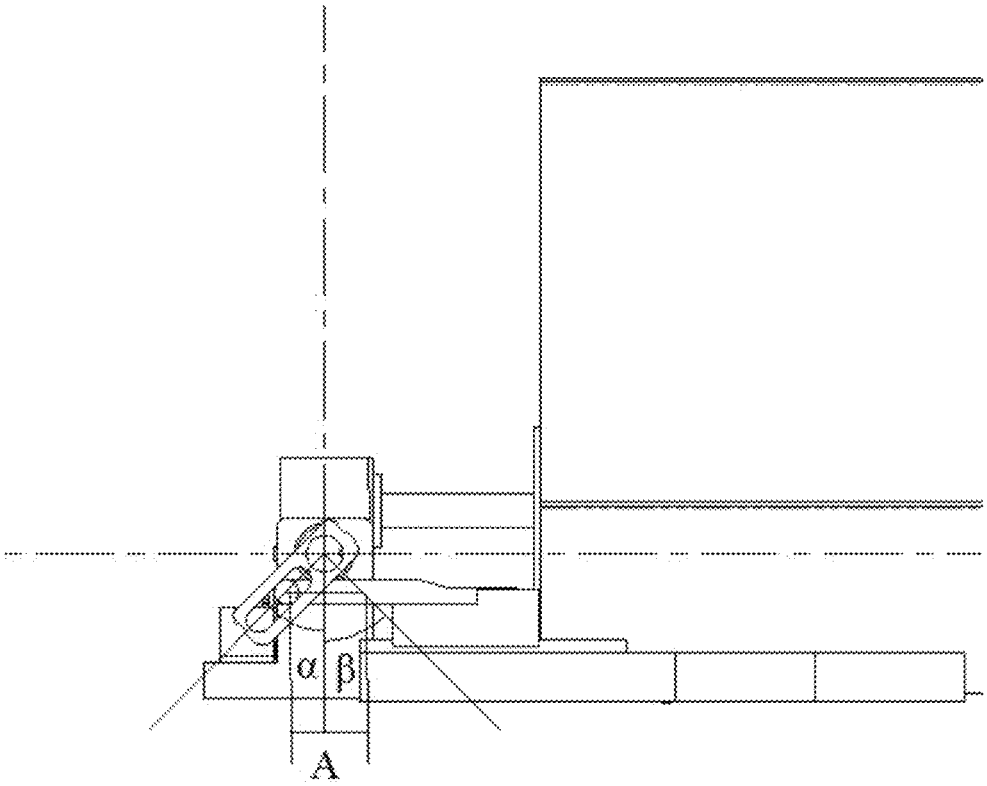
FIG. 19 is a schematic view of a position of the reefing chute when the sail is in a horizontal position according to an embodiment of the present invention.
Figure 20:
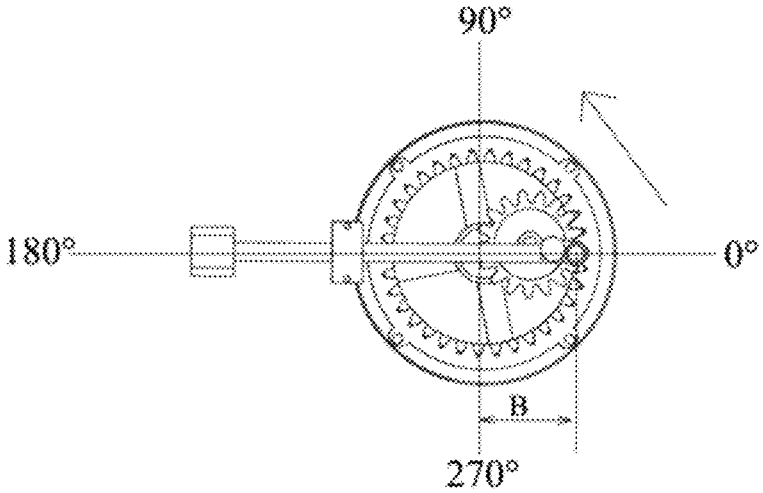
FIG. 20 is a schematic diagram of a maximum displacement of a gear disk connecting rod when the sail is in the horizontal position according to an embodiment of the present invention.

In the case of an emergency which requires furling of the sail and diving into the water: the control system issue an instruction to cause the gybing box 13 to act, so that the transformable sail 16 rotates to coincide with a direction of a long central axis of the vehicle, while the vertical pneumatic locker 1401-2 is retracted to release the self-locking of the gybing box 13. The front ballast water regulating pump 11 acts under the instruction of the control system, and injects water into the front ballast water tank 9 to drive the rack piston 10 to act, thereby driving the drive shaft gear 7 to rotate counterclockwise, achieving rotation of the primary drive shaft 6 and the second belt pulley 8; and the first belt pulley 3 and the reefing drive shaft 2 are rotated by the belt 4, and the primary drive shaft 6 and the reefing drive shaft 2 rotate at the same speed and in the same direction. In this case, the primary drive shaft 6 and the secondary drive shaft 1603 are not in contact due to sail transformation, sail transformation action is not carried out, and only reefing action is performed. In this case, the limiting plate 1602 inside the transformable sail 16 is locked by a tensile force of the limiting spring 1601, and a right self-locking block 1608-1 just catching the wingsail right transformation portion 1608 and a left self-locking block 612-1 of the wingsail left transformation portion 1612 ensure the self-locking without transformation. The reefing drive shaft 2 drives the rotating ring 1502 to rotate, thereby driving the internal gear 1506 to rotate along the external gear 1507, thereby driving the gear disk connecting rod 1501 to move in a bow direction, thereby driving the reefing slider 1404 to move in the bow direction, thereby driving the reefing chute 1403 to move, driving the connecting shaft 1406 to rotate clockwise, thereby realizing clockwise 90 degrees rotation of the gybing box 13; in this case, the horizontal pneumatic locker self-locking hole 1312-1 of the gybing box housing 1312 cooperates with the horizontal pneumatic locker 1401-1 to expand under the action of an external air source to achieve the self-locking, which realizes vertical-to-horizontal reefing action of the transformable sail 16 as the transformable sail 16 is fixed to the base 1311; as shown in FIGS. 18 and 19, where A represents a displacement of the reefing slider 1404 during movement of the transformable sail 16 from a vertical direction to a horizontal direction or from the horizontal direction to the vertical direction; and in FIG. 20, B represents a maximum reciprocating displacement of the gear disk connecting rod 1501, $\alpha$ represents an included angle between the reefing chute 1403 and the vertical direction when the transformable sail 16 is in the horizontal direction, and $\beta$ represents an included angle between the reefing chute 1403 and the vertical direction when the transformable sail 16 is in the vertical direction, where A and B have equal values, and $\alpha=\beta=45°$.

After the reefing action is completed, since the primary drive shaft 6 and the reefing drive shaft 2 still rotate at the same speed and in the same direction, the internal gear 1506 has rotated 90 degrees along the external gear 1507, and the internal gear 1506 continues to rotate along the external gear 1507, but the gear disk connecting rod 1501 does not move any more. That is, the reefing and the sail transformation do not interfere with each other. In this case, the groove 6-1 at the end of the primary drive shaft 6 and the convex column 1603-1 at the end of the secondary drive shaft 1603 coincide and are caught to realize rotary drive of the two shafts; the secondary drive shaft 1603 is partially lifted, so that the limiting plate 1602 is lifted upwards; the right self-locking block 1608-1 of the wingsail right transformation portion 1608 and the left self-locking block 1612-1 of the wingsail left transformation portion 1612 lose limitation by the limiting plate 1602, and then the secondary drive shaft 1603 drives the straight connecting rod 1604 to rotate, thereby driving the sail transformation connecting rod 1605 to deploy the wingsail right transformation portion 1608 and the wingsail left transformation portion 1612 through a right slipway 1608-2 of the wingsail right transformation portion 1608 and a left slipway 1612-2 of the wingsail left transformation portion 1612.

Figure 21A:
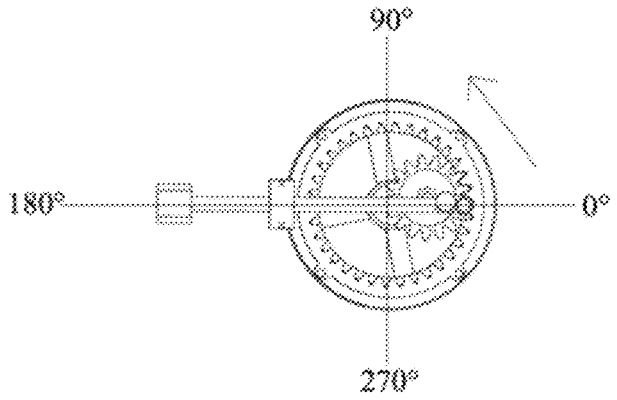
FIG. 21 is a schematic diagram of a state of motion of a gear disk according to an embodiment of the present invention; with 21A representing 0-90 degrees; 21B representing 90-180 degrees; and 21C representing 180-270 degrees.
Figure 21B:
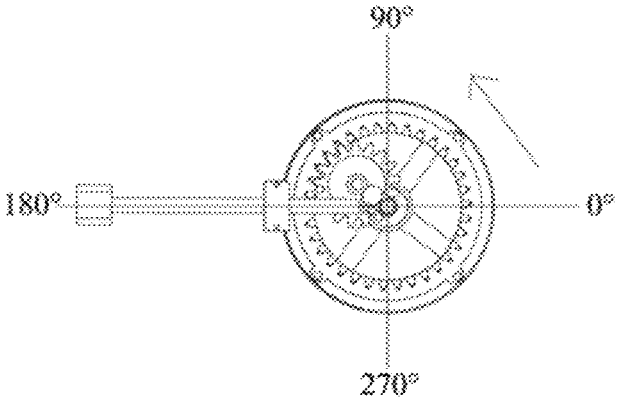
Figure 21C:
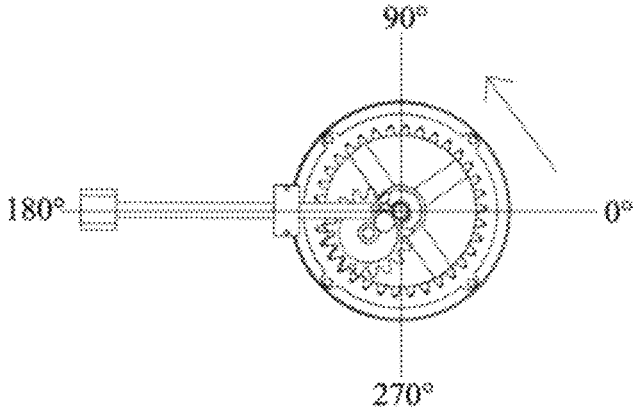

During reefing and sail transformation, the gear disk works according to the following working principle: driven by various drive mechanisms, the internal gear 1506 rotates along the external gear 1507 within 0-270 degrees to realize the reefing and the sail transformation. At 0-90 degrees, the electromagnetic switch 1508 is energized, a front end extends to fix the drive handle 1505 and the internal gear 1506 together, and in this case, the internal gear 1506 rotates along the external gear 1507, so that the gear disk connecting rod 1501 is driven to move. When the internal gear 1506 reaches 90°, the electromagnetic switch 1508 loses power, and the front end contracts to separate the drive handle 1505 from the internal gear 1506, and in this case, a connection between the drive handle 1505 and the gear disk connecting rod 1501 is just at a central position of the rotating ring 1502, and due to cooperation between the horizontal pneumatic locker 1401-1 and the horizontal pneumatic locker self-locking hole 1312-1 of the gybing box housing 1312 after the reefing, the horizontal pneumatic locker 1401-1 expands under the action of the external air source to achieve self-locking, and the gear disk connecting rod 1501 no longer acts; and when the internal gear 1506 rotates along the external gear 1507, the drive handle 1505 is not in the original relative position. If the electromagnetic switch 1508 does not lose power, the internal gear cannot rotate, so the electromagnetic switch 1508 loses power. The movement process is shown in FIGS. 21(*a*), (*b*) and (*c*) respectively.

After the reefing action is completed, under the cooperation of the rear ballast water tank 1 and the front ballast water tank 9, the vehicle dives into the water because a weight thereof under the action of the ballast water is greater than a buoyancy, and after deployment of the transformable sail 16 is completed, the fin rays 1609, the undulating propulsion steering gear 1610 and the flexible fin 1611 are exposed, and a plurality of undulating propulsion steering gears 1610 oscillate in a sinusoidal function to realize oscillation of the flexible fin 1611 and realize undulating propulsion of the vehicle under the water.

The deployment of the wingsail right transformation portion 1608 and the wingsail left transformation portion 1612 is rooted in that the front ballast water regulating pump 11 injects water into the front ballast water tank 9 to drive the rack piston 10. In this case, the control system realizes optimal undulating propulsion efficiency by matching an oscillation angle of the undulating propulsion steering gear 1610 with a deployment angle of the wingsail right transformation portion 1608 and the wingsail left transformation portion 1612 through preset instructions.

After the reefing action is completed, the internal gear 1506 along the external gear 1507 within 90-270 degrees clockwise to deploy the wingsail right transformation portion 1608 and the wingsail left transformation portion 1612, and counterclockwise to furl the wingsail right transformation portion 1608 and the wingsail left transformation portion 1612.

The rudder 19 is driven by the steering gear 18 to rotate according to the instructions of the control system to realize steering of the vehicle during travel.

The vehicle floating process is in a reverse order of the diving process and will not be repeated here.

What is claimed is:

1. A wind-powered water-air interface vehicle suitable for concealed navigation, comprising a hull, a gybing box, a transformable sail and a reefing mechanism, wherein the gybing box is arranged in the hull and comprises a gybing motor, a gear train, a worm wheel and worm mechanism and a base; the worm wheel and worm mechanism are connected with a shaft of the gybing motor by the gear train; the base is connected with the worm wheel and worm mechanism; the transformable sail is fixed to the base; the gybing box is connected with the reefing mechanism; the gybing box operates the transformable sail in a suitable attack angle range or rotates 90 degrees according to a signal sent by a control system;

the reefing mechanism comprises a front ballast water tank, a rack piston, a primary drive shaft, a drive shaft gear, a reefing drive shaft, a gear disk and a slider crank mechanism; a piston end of the rack piston and the front ballast water tank form a piston structure; a rack end of the rack piston is intermeshed with the drive shaft gear; the drive shaft gear is connected with the primary drive shaft; the primary drive shaft and the reefing drive shaft are connected by a belt gear; the reefing drive shaft is connected with the gear disk; one end of the slider crank mechanism is connected with the gear disk, and the other end of the slider crank mechanism is connected with a housing of the gybing box by a connecting shaft; the front ballast tank is charged with seawater under control of the control system, drives the rack piston to act, and drives the primary drive shaft, the reefing drive shaft and the gear disk to rotate, and thus drives the slider crank mechanism to rotate the gybing box with the connecting shaft; and the transformable sail comprises a secondary drive shaft, a wingsail fixing portion, a wingsail right transformation portion and a wingsail left transformation portion; the wingsail right transformation portion and the wingsail left transformation portion are hingedly connected with the wingsail fixing portion; the wingsail fixing portion is fixed to a transformable sail base, an upper end of the secondary drive shaft passes through the wingsail fixing portion and is fixed to a limiting plate, and a lower end of the secondary drive shaft is configured to connect with the primary drive shaft; a Z-shaped connecting rod mechanism is mounted on an upper portion of the secondary drive shaft; both ends of the Z-shaped connecting rod mechanism are respectively connected with the wingsail right transformation portion and the wingsail left transformation portion by flexible joints; and when the secondary drive shaft is connected with the primary drive shaft, the secondary drive shaft rotates with the primary drive shaft to drive the Z-shaped connecting rod mechanism to rotate, so that the wingsail right transformation portion and the wingsail left transformation portion are deployed or furled.

2. The wind-powered water-air interface vehicle according to claim 1, wherein the slider crank mechanism comprises a reefing limiting box, a reefing bracket, a reefing chute, a reefing slider, a rail base and a connecting shaft; and the reefing slider is mounted to a sliding rail of the rail base, one end of the reefing slider is mounted in the reefing chute, the reefing sliding groove is mounted to the reefing bracket by a connecting shaft, and the reefing limiting box is mounted to the reefing bracket by screws.

3. The wind-powered water-air interface vehicle according to claim 2, wherein the gear disk comprises a rotating ring, a gear disk base, an internal gear, a drive handle, an electromagnetic switch and an external gear; the rotating ring is mounted to the gear disk base by a bearing, the internal gear is mounted to a gear column on the rotating ring, the drive handle is a rotatable joint, one end thereof is mounted to an upper end of the gear column on the rotating ring, and the other end thereof is connected with a gear disk connecting rod; the external gear is fixed to the gear disk base by screws, the internal gear is meshed with the external gear, and the gear disk base is fixed to the rail base by screws; the gear disk connecting rod is connected with the reefing slider; and the drive handle is provided thereon with the electromagnetic switch for controlling connection and disconnection of the drive handle and the internal gear.

4. The wind-powered water-air interface vehicle according to claim 2, wherein the reefing limiting box is provided thereon with a vertical limiter and a horizontal limiter for limiting and fixing the transformable sail at a vertical position and a horizontal position respectively.

5. The wind-powered water-air interface vehicle according to claim 1, further comprising an undulating propulsion mechanism, wherein the undulating propulsion mechanism comprises a flexible fin, a plurality of fin rays and an undulating propulsion steering gear, and the flexible fin is fixed to the fin rays; and each fin ray is connected to an undulating propulsion steering gear.

* * * * *